United States Patent [19]

McKenna

[11] Patent Number: 4,903,869

[45] Date of Patent: Feb. 27, 1990

[54] BRUSH STORAGE AND FLUID DISPENSING DEVICE

[75] Inventor: Marvin G. McKenna, North Vancouver, Canada

[73] Assignee: McPride Marketing Inc., White Rock, Canada

[21] Appl. No.: 189,906

[22] Filed: May 3, 1988

[51] Int. Cl.[4] ..... A47L 13/56

[52] U.S. Cl. ..... 222/449; 15/257.05; 220/20.5

[58] Field of Search ..... 222/576–579, 222/583, 585–589, 425, 437, 449, 453, 457, 484, 510, 518; 15/257.05, 257.07; 206/209, 361; 220/20.5; 401/118, 120–122, 126–127, 129

[56] References Cited

U.S. PATENT DOCUMENTS

| | | | |
|---|---|---|---|
| 392,342 | 11/1888 | Jones | 222/576 |
| 1,838,490 | 12/1931 | Lerum | 15/257.05 |
| 2,674,757 | 4/1954 | Keyes, Jr. | 222/517 X |
| 2,782,909 | 2/1957 | McNamara | 206/209 |
| 2,936,765 | 5/1960 | Talkington | 220/20.5 X |
| 3,436,784 | 4/1969 | Moore, Jr. | 15/257.05 |

FOREIGN PATENT DOCUMENTS

| | | | |
|---|---|---|---|
| 495527 | 6/1952 | Italy | 220/20.5 |
| 136949 | 12/1929 | Switzerland | 206/209 |

*Primary Examiner*—Michael S. Huppert
*Attorney, Agent, or Firm*—Townsend and Townsend

[57] ABSTRACT

A dispensing apparatus for dispensing fluid from a container having an annular flange at its top, the apparatus comprising a cover portion for releasably mounting to the container in order to seal the container. There is an aperture in the cover portion communicating with a well portion that extends from the cover portion and into the container when the dispensing apparatus is in place. A well cover is also provided for removably mounting over the aperture in order to seal the well portion. The apparatus has valve means for allowing fluid into the well portion. A paint brush or like device can be dipped into the well portion for dispensing fluid and the paint brush can also be stored in the well to prevent the brush from drying out.

9 Claims, 2 Drawing Sheets

BRUSH STORAGE AND FLUID DISPENSING DEVICE

FIELD OF THE INVENTION

This invention relates to a fluid dispenser for use with containers such as paint cans or the like.

BACKGROUND OF THE INVENTION

A large variety of fluid or semi-fluid products are sold today in can-like containers having a removable lid with a lip for engagement in an annular flange about the container's top. The most common commodity held in such a container is paint, however, fluids such as glues, varnishes, stains, lubricating oils and cooking oils are among the numerous other commodities sold in these containers.

These containers have a number of problems associated with them. First, there is the problem of dispensing the fluid from the container. Often, this is done by dipping an application tool, most commonly a paint brush, into the container in order to collect fluid. Often it is necessary to wipe the brush on the annular flange about the container's top to remove excess fluid and prevent dripping. Such action, however, tends to clog the annular flange of the container so that the removable lid is difficult to re-seal on the container. As a result, once opened, the fluid contents of a container often dry out due to air exposure before they can be completely used up.

Despite these problems, it is still desirable to dispense a fluid from the standard container in which it is originally packaged rather than transferring the fluid to a specially constructed dispensing container. Special dispensing containers present an additional cost and the transfer process can be messy and time consuming.

Therefore, there exists a need for a fluid dispenser that can be attached to a standard container and prior art devices for such a dispenser exist.

For example, U.S. Pat. No. 1,838,490 to Lerum discloses a cover, brush holder and squeezer for fluid containers for attachment to the top of a container. The device includes a fairly complex combined brush holder and squeezer attachment that is hingedly attach to the cover.

U.S. Pat. No. 3,436,784 to Moore, Jr. discloses a floating paint brush holder for attachment in a standard container. No provision is made for sealing the container and preventing the fluid from drying out.

For certain applications, such as applying paint using a roller brush, it is necessary to dispense the paint into a special container. The present invention also includes an embodiment that can be used with a roller brush.

SUMMARY OF THE INVENTION

In a first embodiment, the present invention is a dispensing apparatus for dispensing fluid from a container having an annular flange at its top, said apparatus comprising:

- a cover portion with attachment means for releasably mounting said cover to the container in order to seal the container;
- an aperture in said cover portion communicating with a well portion that extends from said cover portion;
- a well cover for removably mounting over said aperture in order to seal said well portion;
- valve means for allowing fluid into said well.

The present invention provides a fluid dispensing device that can be attached to a standard container. The lid of the container is removed and the device is installed inside the can with the cover portion being sealed to the top. The sealable cover portion prevents the fluid from drying out and also prevents spills if the container is knocked over accidentally. Fluid is dispensed into the well portion of the container as required by using the valve means. A paint brush is inserted into the well portion to collect the fluid for application. The device also eliminates the need for cleaning paint brushes as the brushes can be stored in the well portion with the well cover in place.

In a second embodiment, the present invention comprises a dispensing apparatus for fluids applied using a roller brush comprising:

- a fluid receptacle having side walls and a base;
- a cover having an angled planar surface extending into the interior of said fluid receptacle between said side walls to define a recessed dispensing well for fluid capable of accepting the roller of a roller brush, said cover serving to seal said fluid receptacle;
- an inlet port for introducing fluid into said receptacle; and
- valve means for allowing fluid into said dispensing well.

In a similar manner to the first embodiment, this dispensing unit for roller brushes prevents paint from drying out by dispensing only a small amount at a time into the dispensing well. In addition, roller brushes can be stored within the dispensing well so that the rollers do not have to be cleaned at the end of every working day.

BRIEF DESCRIPTION OF THE DRAWINGS

Various embodiments of the present invention are illustrated in the following drawings in which.

DESCRIPTION OF THE PREFERRED EMBODIMENTS

Figure 1:
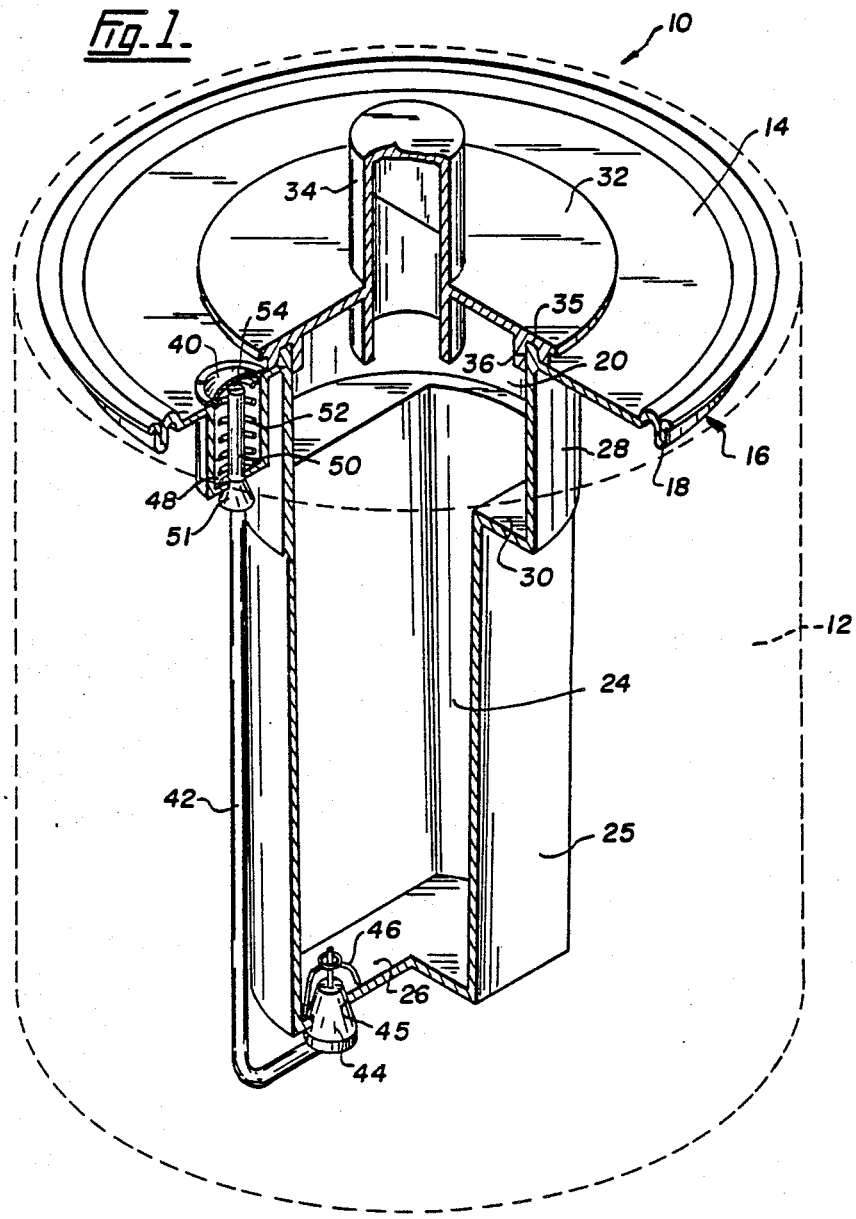
FIG. 1 shows a sectioned view of a first embodiment of the fluid dispenser for use on a container such as a paint can.

Referring to FIG. 1, there is shown a first embodiment of a fluid dispenser 10 according to the present invention mounted on a conventional container 12 such as a paint can shown by dashed lines. The fluid dispenser 10 comprises a cover portion 14 with attachment means 16 about the cover's perimeter so that the cover can be mounted and sealed over the opening of the container 12. This attachment means comprises a grooved lip 18 for engagement in the annular flange about the opening of container 12 in the same fashion that the lid of a paint can mates with the flange to seal the can.

There is a central aperture 20 formed in said central portion. Aperture 20 communicates with a well portion 24 that extends below cover 14 and into the interior of container 12. Well portion 24 is defined by enclosing side walls 25 and base 26. Adjacent cover portion 14, there is an enlarged region 28 that ends at shelf 30. Below shelf 30, well portion 24 is formed into a relatively narrow shaft of sufficient width to accept an application tool such as a paint brush.

Well portion 24 can be covered and sealed at aperture 20 by well cover 32. Well cover 32 is equipped with a hollow handle 34 for gripping and removing the cover. The lower surface of well cover 32 is provided with annular groove 35 which engages corresponding lip 36 formed about the circumference of aperture 20. Such an arrangement provides for a tight and sealable fit of well cover 32 over well 24.

The fluid dispenser of the present invention is also provided with valve means for allowing fluid into the well portion 24 of the dispenser. This valve means includes push button 40 mounted in cover portion 14, L-shaped actuating rod 42 and valve member 44. Valve member 44 is a frusto-conical member that protrudes through tapered hole 45 in base 26 of well portion 24. The frusto-conical shape of valve member 44 allows the member to seat against hole 45 thereby sealing well portion 24 as the valve member moves upwardly. Mounted above hole 45 is a cage 46 shaped to correspond to valve member 44, the cage acting to guide the movement of the valve member.

The movement of the valve member is controlled by push button 40 acting through the L-shaped actuating rod 42. Push button 40 is slidably located within cavity 48 into which the upper end 50 of actuating rod 42 extends. The point at which actuating rod 42 enters cavity 48 is sealed by sealing member 51 to prevent fluid from entering this cavity. Sealing member 51 allows for slidable movement of rod 42. Spring 52 is housed within cavity 48 and acts to bias actuating rod 42 and push button 40 upwardly in open cavity 48. Spring 52 acts against abutting member 54 which is attached to the end of actuating rod 42. Due to the action of spring 52 valve member 44 is normally raised upwardly to seat against hole 45 and seal the well. By pressing downwardly on push button 40 and advancing the button into cavity 48, actuating rod 42 is moved downwardly thereby unseating valve member 44 and allowing fluid from the interior of the container into well portion 24. Releasing push bottom 42 acts to seal the well 24. Push button 40 is not an airtight fit within cavity 48, therefore, air moves past push button 40 and sealing member 51 and into the interior of container 12 when button 40 is pressed to vent the interior of the container.

In use, the fluid dispensing apparatus of the present invention is located atop an open container and cover portion 14 is sealed about the annular flange of the container using grooved lip 18 as shown in FIG. 1. Well portion 24 extends into the fluid in the interior of the container. In order to avoid causing the fluid in the container to overflow as the well is introduced into the fluid, it may be necessary to press button 40 and open valve 44 so that fluid may flow into the well portion. Generally, however, containers of this type holding paint, varnish, contact cement and the like are not filled completely to the rim, and the well portion of the device will not displace a sufficient amount of fluid to cause any overflow.

Figure 2:
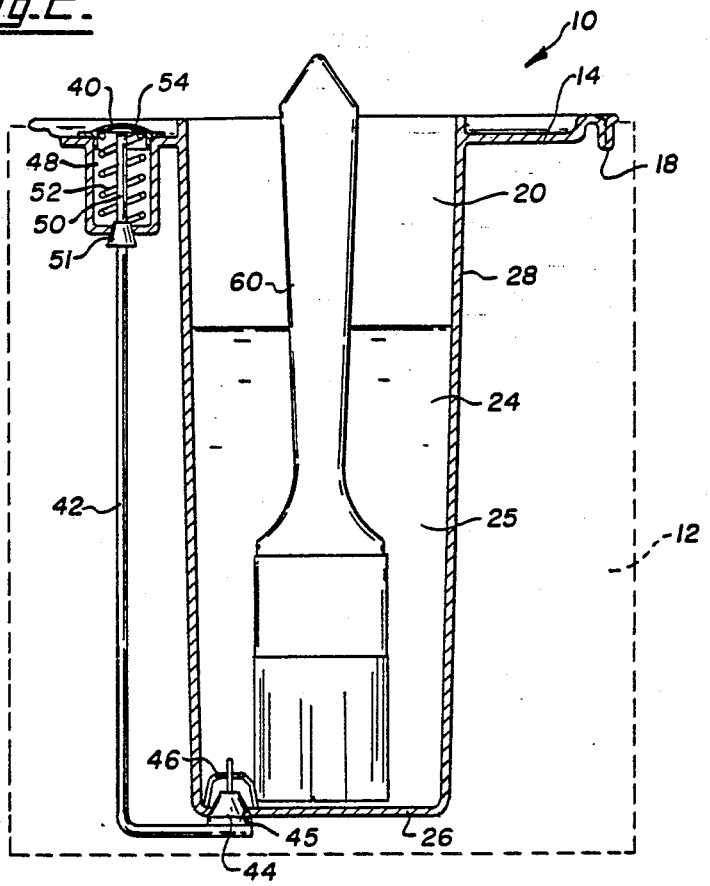
FIG. 2 shows a sectioned view of the first embodiment with the well cover removed and a paint brush inserted into the well.

When in place atop the container, the fluid dispenser seals the container and prevents spills if the container is accidentally knocked over. As shown in FIG. 2, removing well cover 32 allows an application tool such as a paint brush 60 to be inserted into well 24. Push button 40 can be used to control the amount of fluid in well 24. By dipping paint brush 60 into well 24, fluid can be applied to the brush with any excess fluid being brushed off against shelf 30.

When a job is completed, well cover 32 can be replaced over aperture 20 with paint brush 60 still located in the well. If a depth of fluid is left in the well, the paint brush can be stored submerged in the fluid thereby keeping the brush supple and making cleaning of the brush unnecessary. Such an arrangement eliminates the need for expensive cleaning agents.

By sealing the container, the fluid dispenser of the present invention prevents the fluid of the container from drying out. It is a common experience with fluids such as paints and glues that a significant portion of the fluid is wasted as the fluid dries out during use due to exposure to the air. This drying out is virtually eliminating with the present device as small and controlled amounts of fluid can be dispensed at a time into well portion 24 for immediate use.

Necessarily, this first embodiment of the fluid dispenser of the present invention will be made in different sizes to fit the various sizes of standard containers.

Figure 3:
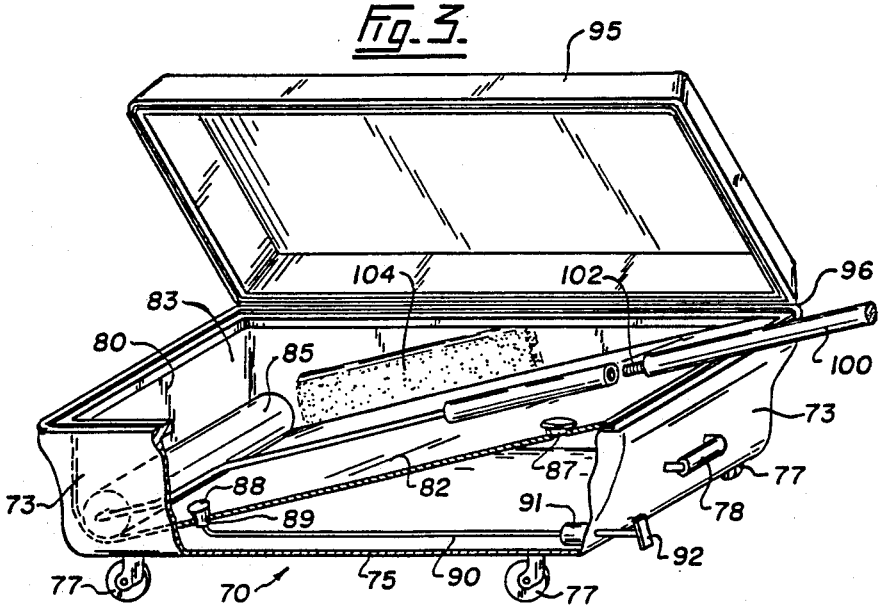
FIG. 3 shows a second embodiment of the present invention for dispensing paint using a roller brush.

Referring now to FIG. 3, there is shown a second embodiment of the present invention for use with roller brushes. There is a receptacle 70 for holding paint or other fluids having side walls 73 and a base 75. Preferably, receptacle 70 is mounted on casters 77 to allow for ease of movement. In this regard, a handle 78 is attached to a side wall 73 to allow the receptacle to be pulled about.

The open top of the receptacle is covered by a removable cover 80 which forms an air tight seal over the receptacle. Cover 80 is formed with an angled planar surface 82 that extends downwardly between side walls 73 into the interior of receptacle 70. Paint or fluid is contained beneath cover 80 in the receptacle portion 70. Angled planar surface 82 defines a recessed dispensing well 83 into which the roller 85 of a roller brush can be inserted in order to collect paint.

Angled planar surface 82 of cover 80 is provided with an inlet port 87 to allow paint or other fluids to be poured into receptacle 70. In addition, it is preferable that cover 80 be removable from atop receptacle 70 so that the interior of the receptacle can be cleaned periodically as would be necessary when changing paint colours.

At the point where angled planar surface 82 approaches base 75, a frusto-conical valve member 88, identical to the valve member 44 of the first embodiment, is located within an aperture 89 formed in the planar surface. An actuating rod 90 extends through the interior of receptacle 70 and through a side wall 73 to join valve member 88 with handle 92. At side wall 73, actuating rod 90 extends through a cavity 91 containing a biasing spring (not shown) which acts to keep valve member 88 seated in aperture 89. In a similar manner to the first embodiment, pushing on handle 92 acts to unseat valve member 88 thereby allowing a quantity of paint to flow from receptacle 70 through aperture 89 and into well 83 to collect in a pool at the bottom of angled planar surface 82. A sealing member that allows for slidable movement of actuating rod 90 is provided at cavity 91 to prevent paint leaking from receptacle 70. In normal use, the dispensing unit of FIG. 3 would be located on the floor, and handle 92 would be activated by pressing with a foot. Once handle 92 is released, the biasing spring in cavity 91 closes the valve to prevent further paint from leaving receptacle 70.

Preferably, a further cover 95 is hingedly attached at 96 to receptacle 70. This cover allows dispensing well 83 to be covered and sealed thereby allowing for storage of a roller 85 in the dispensing well in a pool of paint making cleaning of the brush unnecessary. As illustrated in FIG. 3, the handle 100 of a roller brush has a threaded section 102 that allows the handle to be broken down so that the roller brush can be stored under cover 95 without handle 100 protruding.

As an added feature, the side walls of the dispensing well 83 can be equipped with cleaning strips 104 that remove excess paint from the ends of roller 85 as it is moved on planar surface 83.

I claim:

1. A dispensing apparatus for dispensing fluid from a container having an annular flange at its top, said apparatus comprising:

a cover portion attachment means for releasably mounting said cover to the container in order to seal the container;

an aperture in said cover portion communicating with a well portion that extends from said cover portion;

a well cover for movable mounting over said aperture in order to seal said well portion;

valve means for allowing fluid into said well comprising a valve member adapted for sealing engagement within an aperture in said well portion, said valve member being movable between a normally closed position to seal said aperture and an open position to allow fluid into said well portion through said aperture, actuating means mounted in said cover plate, and an actuating rod interconnecting said actuating means with said valve member whereby operating said actuating means acts to move said valve member to the open position to allow fluid into said well portion.

2. A dispensing apparatus as claimed in claim 1 in which said attachment means comprises a grooved lip about the perimeter of said cover portion for engagement in the annular flange about the top of the container.

3. A dispensing apparatus as claimed in claim 1 in which said well portion comprises side walls and a base to define an enclosure with an interior region extending below said cover portion.

4. A dispensing-apparatus as claimed in claim 3 in which said side walls taper from a region of one diameter adjacent said cover portion to a region of a smaller diameter.

5. A dispensing apparatus as claimed in claim 1 in which said actuating means comprises a push button mounted in said cover plate.

6. A dispensing apparatus as claimed in claim 1 in which said valve member comprises a frusto-conical member that seats within an aperture formed in said well portion.

7. A dispensing apparatus as claimed in claim 1 in which said push button is normally biased by resilient compressible means into a position such that said valve member is in the closed position.

8. A dispensing apparatus as claimed in claim 1 in which said well cover includes a gripping handle.

9. A dispensing apparatus as claimed in claim 8 in which said gripping handle is hollow.

* * * * *